United States Patent [19]

Ohta

[11] 4,221,544

[45] Sep. 9, 1980

[54] REFRIGERANT COMPRESSOR

[75] Inventor: Motomu Ohta, Sakai, Japan

[73] Assignee: Central Automotive Industries Ltd., Sakai, Japan

[21] Appl. No.: 866,777

[22] Filed: Jan. 3, 1978

[30] Foreign Application Priority Data

Aug. 12, 1977 [JP] Japan ..... 52-9205

[51] Int. Cl.[2] ..... F04B 1/14

[52] U.S. Cl. ..... 417/269; 417/313

[58] Field of Search ..... 417/269, 313, 312, 270

[56] References Cited

U.S. PATENT DOCUMENTS

| | | | |
|---|---|---|---|
| 3,557,664 | 1/1971 | Akaike | 417/269 |
| 3,577,891 | 5/1971 | Nemoto | 417/312 |
| 3,785,751 | 1/1974 | Nemoto | 417/312 |
| 3,838,942 | 10/1974 | Pokorny | 417/269 |

FOREIGN PATENT DOCUMENTS

| | | | |
|---|---|---|---|
| 2303969 | 8/1976 | France | 417/269 |

*Primary Examiner*—William L. Freeh

*Attorney, Agent, or Firm*—Haseltine, Lake & Waters

[57] ABSTRACT

A refrigerant compressor for effecting successive compression and exhaust strokes by the reciprocating action of a piston driven by an inclined oscillating plate. A rotor chamber communicates with an air inlet chamber through an air inlet silencer chamber while an exhaust chamber communicates with an outlet via an exhaust silencer chamber. The exhaust silencer chamber communicates with a lower sump chamber through a separator so that lubricating oil can be separated in the exhaust chamber and can flow to the sump chamber wherefrom the lubricating oil can flow back to the rotor chamber through a bore in a rotor drive shaft which communicates with the sump chamber through an orifice.

10 Claims, 4 Drawing Figures

REFRIGERANT COMPRESSOR

FIELD OF THE INVENTION

The present invention relates to improvements in a refrigerant compressor used, for example, for an air conditioner of a vehicle, such as the cooling apparatus of an automobile.

PRIOR ART

In this type of refrigerant compressor, since refrigerant gas leaks under pressure past the peripheral face of a piston and flows into a rotor chamber to increase the pressure inside the rotor chamber, the leaked refrigerant gas in the rotor chamber flows back to the air inlet side. Lubricating oil inside the rotor chamber is thereby stirred to lubricate each bearing portion, and the lubricating oil flows to the air inlet side with the refrigerant gas and returns to the rotor chamber. However, at the air inlet side, the oil is atomized to form drops or the lubricating oil is in ebullition condition produced by abrupt pressure decrease particularly during starting and the oil is mixed, in large quantities, in the refrigerating machine to reduce the refrigeration efficiency while the lubricating operation in the compressor is reduced due to gradual increase in the temperature of the lubricating oil inside the rotor chamber. Furthermore, the pressure inside the rotor chamber rises due to the leaked compressed refrigerant gas which makes it difficult for the lubricating oil to flow smoothly back to the rotor chamber from the air inlet side. Accordingly, the lubricating oil had to be fed positively to the rotor chamber through a special oil delivery means.

Also, noise is produced through the pulsation phenomena of the refrigerant gas caused by the reciprocating motion of the piston, thus preventing smooth operation of the compressor.

SUMMARY OF THE INVENTION

An object of the invention is to provide a compressor in which the disadvantages associated with the known compressors are overcome.

In accordance with the above and further objects of the invention, there is provided a refrigerant compressor wherein the lubricating oil, which flows to the air inlet side together with the leaked refrigerant gas blown into the rotor chamber past the peripheral face of the piston, is mixed with the incoming refrigerating gas and is sucked into the cylinder from the air inlet chamber, the mixture of compressed refrigerant gas at high pressure and lubricating oil being discharged into an exhaust silencer chamber whereat the refrigerating gas is separated by a separator plate so that only the lubricating oil is introduced into a sump chamber from which the lubricating oil flows back to the rotor chamber through a central bore in the rotor driving shaft automatically by the high pressure prevailing in the sump chamber.

BRIEF DESCRIPTION OF THE DRAWINGS

The invention will be described hereinafter with reference to the drawings.

DETAILED DESCRIPTION

Figure 1:
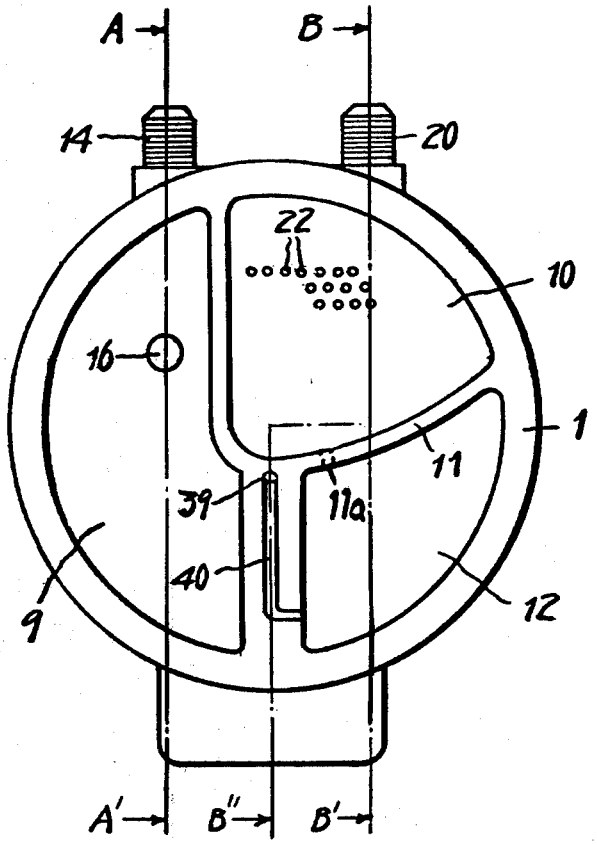
FIG. 1 is an end view of a cylinder of a compressor with the cover body removed.
Figure 2:
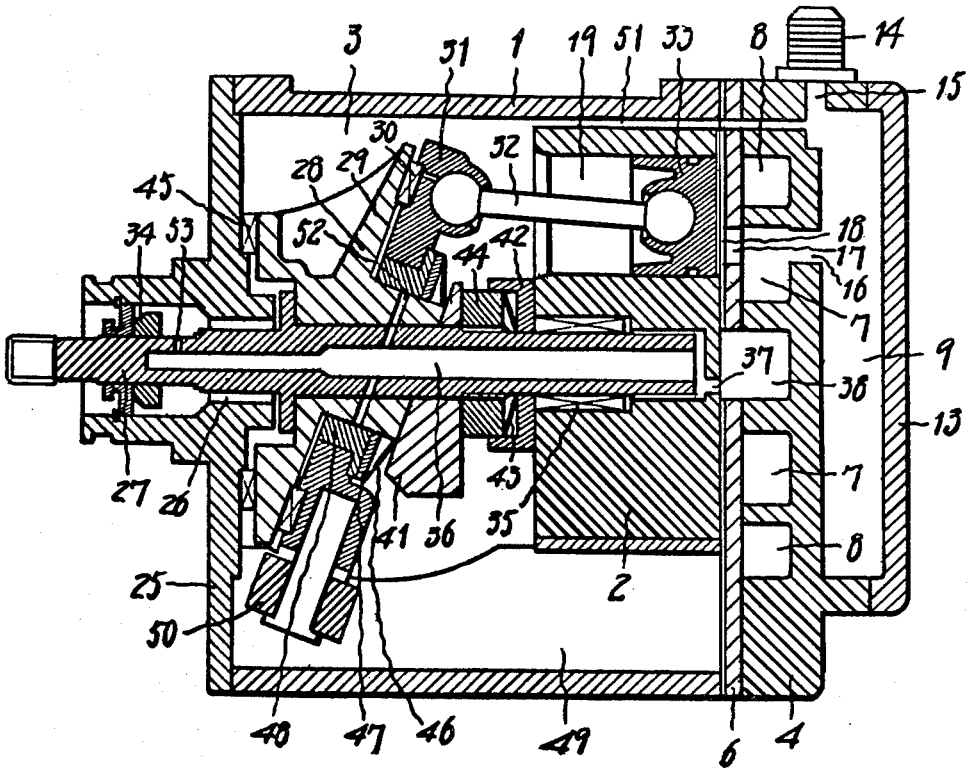
FIG. 2 is a cross-sectional view taken along line A—A' in FIG. 1.
Figure 3:
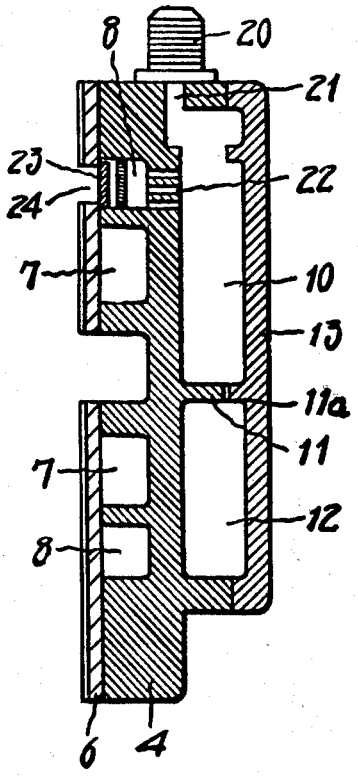
FIG. 3 is a cross-sectional view of a cylinder head taken along line B—B' in FIG. 1.
Figure 4:
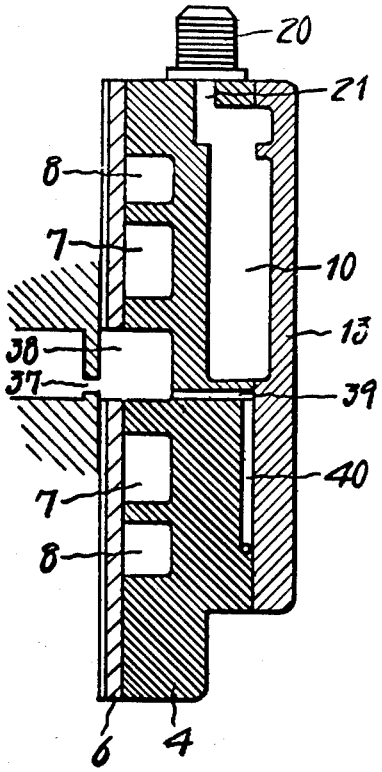
FIG. 4 is a cross-sectional view of the cylinder head taken along line B—B'' in FIG. 1.

A casing 1 of the compressor has a cylinder block 2 therein at one end and a rotor chamber 3 is formed in the casing at its other end. A cylinder head 4 is secured to one end of the casing 1 and a suction valve 18 and a valve plate 6 are interposed between the cylinder head 4 and the top face of the cylinder block 2. The cylinder head has an air inlet chamber 7 in a central portion on the inner face of the cylinder head and an exhaust chamber 8 around the air inlet chamber. The cylinder head has an air inlet silencer chamber 9 at one lateral side portion at the outer face of the cylinder head. The cylinder head has an exhaust silencer chamber 10 in an upper portion of the other lateral side of the cylinder head and a sump chamber 12 in the lower portion. The chamber 10 is separated from chamber 12 by a separator 11. An orifice **11*a* is provided in separator 11. A cover body 13 is secured to the outer end of the cylinder head 4. The air inlet silencer chamber 9, the exhaust silencer chamber 10 and the sump chamber 12 are formed between the inner face of the cover body and the outer face of the cylinder head 4**.

A nipple 14 serves for inlet of the refrigerant gas, the nipple 14 being at the top end portion of the air inlet silencer chamber 9. The nipple 14 communicates with the air inlet chamber 7 through an air inlet hole 15 in the side wall of head 4, the air inlet silencer chamber 9 and a passage 16 formed in the top wall of head 4. An air inlet port 17 formed in valve plate 6 communicates with the air inlet chamber 7. The air inlet port 17 communicates with a cylinder bore 19 in the cylinder block 2 through an air inlet valve 18. A nipple 20 for discharge of the refrigerant gas is mounted on the top end of the exhaust silencer chamber 10. The nipple 20 communicates with the exhaust chamber 8 through an exhaust hole 21 formed in the side wall of cylinder 4, the exhaust silencer chamber 10 and a multiplicity of orifices 22 formed in the top wall of cylinder 4. The chamber 8 communicates with the cylinder bore 19 through an exhaust valve 23 and an exhaust port 24.

A cover 25 is secured to the other end of the casing 1. The cover supports a rotor driving shaft 27 rotatably through a bearing 26. A rotor body 28 is fixed to shaft 27 inside the rotor chamber 3. An inclined oscillating plate 31 is supported, through a bearing 30, on an inclined flange face 29 of the body 28 and is adapted to oscillatingly move the inclined oscillating plate 31 as the shaft 27 rotates. The inclined oscillating plate 31 is coupled to a piston 33, which is slidably engaged in the cylinder bore 19, by a universal joint 32.

A mechanical seal 34 is provided in the cover body 25 to seal one end of the rotor driving shaft 27. The rotor driving shaft 27 is supported at its other end by the cylinder block 2 through a bearing 35. A central blind bore 36 is drilled in the shaft 27 and communicates with an expansion chamber 38, which is formed in the center of the cylinder head 4, through an orifice 37 provided in the end portion of the cylinder block 2. The expansion chamber 38 communicates with the sump chamber 12 through orifices 39 and 40 in the wall in the cylinder head 4 separating chamber 9 from chamber 10 and 12. Numeral 41 is an axial pressing plate for the rotor body 28. The pressing plate cooperates with a seat plate 42 through the intermediary of a leaf spring 43 and a clamping nut body 44 engaged against the cylinder block 2 to bring the rotor body 28 into pressure contact with the cover body 25 through a bearing 45 whereby the rotor body 28 is prevented from moving axially. The rotor body is brought into pressure contact against the inclined oscillating plate 31 through the intermediary of leaf spring 46, thrust plate 47 and bush 48. The inclined oscillating plate 31 is then rotatably supported through the bush 48 and the bearing 30 with respect to the rotor body 28.

An oil sump 49 is provided at the lower end of the rotor chamber 3. A trunnion block 50 is mounted at the lower end of the inclined oscillating plate 31, and undergoes rocking movement in the sump as the plate 31 oscillates.

A passage 51 is provided between the wall of casing 1 and cylinder block 2 to provide communication between the rotor chamber 3 and the air inlet side, the passage 51 extending longitudinally between the inner peripheral face of the casing 1 and the outer peripheral face of the cylinder block 2 at the upper end of the casing 1.

A hole 52 is provided in the rotor body to establish communication between the central bore 36 in the rotor driving shaft 27 and the inner peripheral face of the bush 48 supporting the inclined oscillating plate 31. A hole 53 is formed in the shaft 27 to establish communication between the central bore 36 in shaft 27 and the bearing 26 for the rotor driving shaft 27 and the mechanical seal 34.

The operation of the compressor is as follows:

The inclined oscillating plate 31 is driven in oscillation through the rotor body 28 by the rotation of the rotor driving shaft 27, and piston 33 undergoes reciprocation through the universal joint 32 as is known. During the retraction (air inlet process) of the piston 33, the refrigerant gas flows through the air inlet hole 15, the air inlet silencer chamber 9 and the passage 16, into the air inlet chamber 7 from the nipple 14 and furthermore pushes the air inlet valve 18 away from the air inlet port 17 to flow into the cylinder bore 19. Then, during the advance (exhaust process) of the piston 33, the gas pushes the exhaust valve 23 away from the exhaust port 24 and the gas is discharged into the exhaust chamber 8. Then, the gas is discharged to the exhaust silencer chamber 10 through the orifices 22 and is fed under pressure through hole 21 and nipple 20 to a refrigerating apparatus (not shown) such as an evaporator, a condenser, or the like.

In this case, some of the refrigerant gas is blown as leakage gas into the rotor chamber 3 through the gap between the piston 33 and the surface of the cylinder bore 19.

Lubricating oil inside the oil sump is stirred by the trunnion block 50. The atomized oil flows, during the retraction stroke (air inlet process) of the piston 33, to the suction valve through the passage 51, together with the leaked refrigerant gas. The mixture of leaked gas and lubricating oil is mixed in atomized condition in the air inlet silencer chamber 9 with fresh incoming refrigerant gas from the nipple 14 and is sucked into the cylinder bore 19 through the air inlet chamber 7. Then, during the advance stroke (exhaust process) of the piston 33, the atomized oil, together with the compressed refrigerant gas, which has been discharged into the exhaust silencer chamber 10 from the exhaust chamber 8 collides against the inner face of the cover body 13 due to inertia force and is separated from the refrigerant gas. The drops of oil fall by gravity and the gas is further separated by the separator 11. The drops of oil flow into the sump chamber 12 through orifice 11*a*. The sump chamber 12 increases in pressure due to the compressed refrigerant gas. The lubricating oil collected inside the sump chamber 12 flows through orifice 40 and is discharged as a jet into the expansion chamber 38 through orifice 39. At this time, the temperature of the lubricating oil decreases through the sudden expansion of a very small amount of refrigerant gas mixed with the lubricating oil and the cooled lubricating oil passes into the central bore 36 of the rotor driving shaft 27. Some of the cooled lubricating oil flows onto the inner face of the bush 48 via hole 52 to lubricate the bush 48, the bearing 30, etc. Another portion of the cooled lubricating oil flows from the hole 53 to lubricate the bearings 26,45, the mechanical seal 34, etc. Still another portion of the lubricating oil lubricates the bearing 35, the thrust plate 44, etc. by flowing around the outer periphery of the rotor shaft 27 to return to the oil sump 49.

As described hereinabove, according to the present invention, in the compressor which effects a compression operation through the reciprocating movement of the piston under the driving operation of the inclined oscillating plate, the rotor chamber is caused to communicate with the air inlet side of the compressor and with the air inlet chamber through the air inlet silencer chamber provided on the air inlet side, the exhaust chamber communicating with the exhaust silencer chamber, the exhaust silencer chamber communicating with the lower sump chamber through the separator, the lubricating oil inside the sump chamber flowing back to the rotor chamber through the central bore in the rotor driving shaft communicating with the sump chamber through the orifice 39. Accordingly, the lubricating oil which has been mixed with the leaked refrigerant gas and has flowed into the air inlet side is separated, at the exhaust side, from the gas and flows into the sump chamber and then back to the rotor chamber. However, at this time, as the sump chamber is high in pressure due to the compressed refrigerant gas, the lubricating oil will flow back automatically to the rotor chamber without the need for any special oil delivery means. Since the refrigerant gas mixed in the sump chamber cools the lubricating oil due to the sudden expansion caused in the jet discharge through the orifice 39, the lubricating oil inside the oil sump can be normally kept at low temperature to improve the lubricating performance. Sufficient lubricating operation can be effected by a small amount of sealed lubricating oil. Also, since the sump chamber is provided on the exhaust side, the lubricating oil inside the sump chamber has no possibility of assuming an ebullition phenomenon due to abrupt decrease in pressure on the air inlet side during the starting operation. Also, even during a severe low speed operating condition at high exhaust pressures, the pressure of the sump chamber rises with increase in the exhaust pressure, thus resulting in increased delivery in the amount of the lubricating oil. A sufficient lubricating operation is performed, ensuring longer periods of service of the compressor.

In addition, since the small-sized air inlet silencer chamber and exhaust silencer chamber are incorporated respectively on the air inlet side and the exhaust side to prevent noise caused by the pulsation of the compressor, the present invention has various effects in that the apparatus is compact in construction and low in cost without the need for a special silencer.

What is claimed is:

1. In a refrigerant compressor having a rotor chamber containing an oscillating plate driven by a rotor body secured to a rotatable shaft, the oscillating plate being coupled to a piston to produce reciprocation thereof in a cylinder to provide successive advance and retraction strokes, the compressor further having an inlet for fresh refrigerant gas to be compressed, an outlet for compressed refrigerant gas, an inlet for receiving refrigerant gas from the inlet for supply to the cylinder and an exhaust chamber for discharge of compressed refrigerant gas from the cylinder to said outlet, a sump containing lubricating fluid in the rotor chamber adapted for being stirred to effect lubrication in the rotor chamber, a passage being provided between the rotor chamber and the inlet chamber for return of compressed refrigerant gas which has leaked past the piston together with atomized lubricating fluid which becomes mixed with the compressed refrigerant gas, the improvement comprising an inlet silencer chamber between the inlet and the inlet chamber, an exhaust silencer chamber between the exhaust chamber and the outlet, means for separating lubricating fluid from compressed gas in said exhaust silencer chamber, a sump chamber communicating with the exhaust silencer chamber for receiving separated lubricating fluid with compressed refrigerant gas, and means for returning the separated lubricating fluid to the rotor chamber under the action of said compressed refrigerant gas.

2. The improvement as claimed in claim 1 comprising a separator between the exhaust silencer chamber and the sump chamber, said separator having an orifice for flow of separated lubricant fluid from the exhaust silencer chamber and the sump chamber.

3. The improvement as claimed in claim 2 wherein said exhaust silencer chamber is above the sump chamber.

4. The improvement as claimed in claim 3 wherein the means for separating lubricating fluid comprises orifice means for discharging exhaust gases with lubricating fluid from the exhaust chamber into the exhaust silencer chamber, the exhaust silencer chamber having a wall means facing said orifice means whereby the mixture of exhaust gases and lubricating fluid is propelled against said wall means and lubricating fluid flows downwardly by gravity towards the sump chamber, said outlet for compressed refrigerant gas being positioned above the exhaust silencer chamber for flow of exhaust gases therefrom.

5. The improvement as claimed in claim 4 wherein said means for returning the separated lubricating fluid to said rotor chamber comprises further orifice means for feeding the separated lubricating fluid from the sump chamber in the form of a jet, under the pressure of the exhaust gas, towards the rotor chamber.

6. The improvement as claimed in claim 5 wherein the rotatable shaft has a longitudinal bore communicating with the further orifice means for receiving the lubricating fluid, said shaft having outlet bores leading into said longitudinal bore for discharging the lubricating fluid.

7. The improvement as claimed in claim 4 wherein the compressor has a cylinder head with the exhaust and inlet chambers provided therein, and a cover on said cylinder head defining therewith the exhaust and inlet silencer chambers and the sump chamber.

8. The improvement as claimed in claim 7 wherein said cylinder head has a hole providing communication between the inlet silencer chamber and the inlet chamber.

9. The improvement as claimed in claim 8 wherein said orifice means is constituted by a plurality of orifices provided in the cylinder head between the exhaust chamber and the exhaust silencer chamber.

10. The improvement as claimed in claim 9 comprising separator means between the sump chamber and the inlet silencer chamber, said orifice means being disposed in said separator means and being connected to said sump chamber, said cylinder head having an expansion chamber communicating with the rotor chamber, said orifice means opening into said expansion chamber.

* * * * *